United States Patent [19]

Wierschke

[11] Patent Number: 4,500,393

[45] Date of Patent: Feb. 19, 1985

[54] METHOD FOR THE MANUFACTURE OF RECORD STAMPERS

[75] Inventor: Donald J. Wierschke, Brownsburg, Ind.

[73] Assignee: RCA Corporation, New York, N.Y.

[21] Appl. No.: 605,240

[22] Filed: Apr. 30, 1984

[51] Int. Cl.[3] ..... C25D 1/10

[52] U.S. Cl. ..... 204/5

[58] Field of Search ..... 204/5

[56] References Cited

U.S. PATENT DOCUMENTS

| | | | |
|---|---|---|---|
| 2,092,830 | 9/1937 | Hunter et al. | 18/5.3 |
| 2,491,068 | 12/1949 | Adams | 18/5.3 |
| 3,227,634 | 1/1966 | Rinzema et al. | 204/5 |
| 3,431,333 | 3/1969 | Fiornascente | 204/5 |
| 4,431,487 | 2/1984 | Weaver | 204/5 |

*Primary Examiner*—Thomas Tufariello

*Attorney, Agent, or Firm*—Birgit E. Morris; Edward J. Sites

[57] ABSTRACT

A method is provided for the manufacture of record stampers having electroformed inner and outer edges of a predetermined configuration. In the disclosed method, a flat matrix is formed from a ductile metal. The inner and outer sections of the matrix are shaped into a form which is the mirror image of inner and outer edges desired be formed on the stamper. A metal, preferably a relatively hard metal, is then electroformed on the surface of the matrix in a preselected thickness required for the stamper. The resulting stamper is then stripped from the surfaces of the matrix. The stamper which is obtained will have electroformed inner and outer edges of the predetermined configurations.

6 Claims, 6 Drawing Figures

METHOD FOR THE MANUFACTURE OF RECORD STAMPERS

This invention relates to a method for manufacture of stampers used in the pressing of molded records. More particularly, this invention is concerned with an improved method for forming the inner and outer edge of the stampers so as to increase the useful life of the stampers.

BACKGROUND OF THE INVENTION

In the manufacture of molded records, such as conventional audio records or the more recently developed capacitive electronic discs, a thermoplastic material is molded between a pair of metal disc-shaped parts referred to as stampers. The stampers have defined in their molding surface a spiral information track which contains a surface relief pattern corresponding to the program information desired to be reproduced on playback of a molded record pressed with the stampers.

Stampers are the end product of a multi-step process which is broadly referred to as matrixing. The first step of the matrixing process is to record the program information on a magnetic tape. The magnetic tape is used to control a tool which cuts a recording substrate with a spiral information track having a surface relief pattern corresponding to the recorded program information. The recording substrates which are typically employed are flat metal discs which have a layer of a relatively soft material formed on one surface thereof into which the spiral information track is cut.

The recording substrate cut with the spiral information track is replicated in a series of electroforming steps. In the first of the electroforming steps, a metal, such as nickel, is electrodeposited on the recorded surface of the recording substrate until a self-substaining part of a predetermined thickness is obtained. The resulting electroformed matrix, called a master, is then separated from the recording substrate and replicated. After a predetermined thickness of metal has been deposited on the master, the resulting matrix, referred to as a mother, is separated from the surface of the master. The mother which is obtained is then in turn likewise replicated to produce a part referred to as a stamper. The stamper which is obtained is a negative replica of the recording substrate. The stamper will have formed in its molding surface a mirror image of the spiral information track which was originally cut into the recording substrate and will be of a flat disc-shaped configuration like a recording substrate.

The stampers obtained directly from the matrixing process described above are not suitable as formed for use in the presses conventionally employed in the molding of records. The flat stampers obtained from the above-described matrixing process are in effect stamper blanks which must be subjected to a number of edge shaping steps in order to have the required configuration for mounting on the molding platens of conventional record molding presses. The flat stampers from the matrixing process are trimmed. A center hole is cut into the flat stampers which has a precise diameter and is concentric with the recorded area of the stamper. The outer edge of the flat stamper is also trimmed to a precise diameter concentric with the recorded area of the stampers. After the stampers are trimmed, the inner and outer edges are further shaped to form a tube-like extension about the center hole which is used to secure the center of the stamper to the molding platen. The outer edge of the stamper is likewise shaped in a stamping operation which results in the outer edge being shaped so as to mold an outer bead on the molded record as well as to form the flash and provide a land area for molding. In addition, a circumferencial section is formed about the outermost edge for engaging the outer edge of the molding platen.

The requirement for shaping of the inner and outer edges of the stampers is a source of considerable problems. It is highly desirable that the stampers be as hard as possible so as to resist scratching, dents and other types of mechanical damage during handling and pressing. However, since the flat stampers from the matrixing process are shaped in stamping operations as noted above, it is also necessary that the metal of the stampers be sufficiently ductile to permit deformation during stamping without cracking occurring, either as the stampers are shaped, or thereafter when the stampers are used in the molding of records. The requirement for ductility of flat stampers manufactured by the above-described matrixing process has resulted in there being an undesirable trade-off of hardness for ductility. Furthermore, it has been found that despite compromises being made in the hardness in order to obtain ductility, almost all of the problems encountered with conventional stampers during the pressing of records can be directly traced back to the stamping steps used to shape the inner and outer edges. The stampers having the edges shaped by stamping as described above, when used in the molding of records, usually fail as a result of fatigue cracking at the shaped inner or outer edge of the stampers. This is believed to be due to the stresses that are introduced into the shaped inner and outer edges during stamping and to thinning of the metal of the shaped edges.

What would be highly desirable would be an improved method for the manufacture of stampers having a relatively high hardness in the recorded areas and increased resistance to fatigue cracking at the inner and outer edges.

BRIEF SUMMARY OF THE INVENTION

A method is provided for the manufacture of record stampers having electroformed inner and outer edges. In the disclosed method, a flat matrix is formed from a relatively ductile metal. The inner and outer sections of the matrix are shaped into a configuration which is the mirror image of inner and outer edges desired be electroformed on the stamper. A metal, preferably a relatively hard metal, is then electroformed on the surface of the shaped matrix in a preselected thickness required for the stamper and the resulting stamper is stripped from the surfaces of the shaped matrix. The stamper which is obtained will have electroformed inner and outer edges.

DETAILED DESCRIPTION

Figure 1:
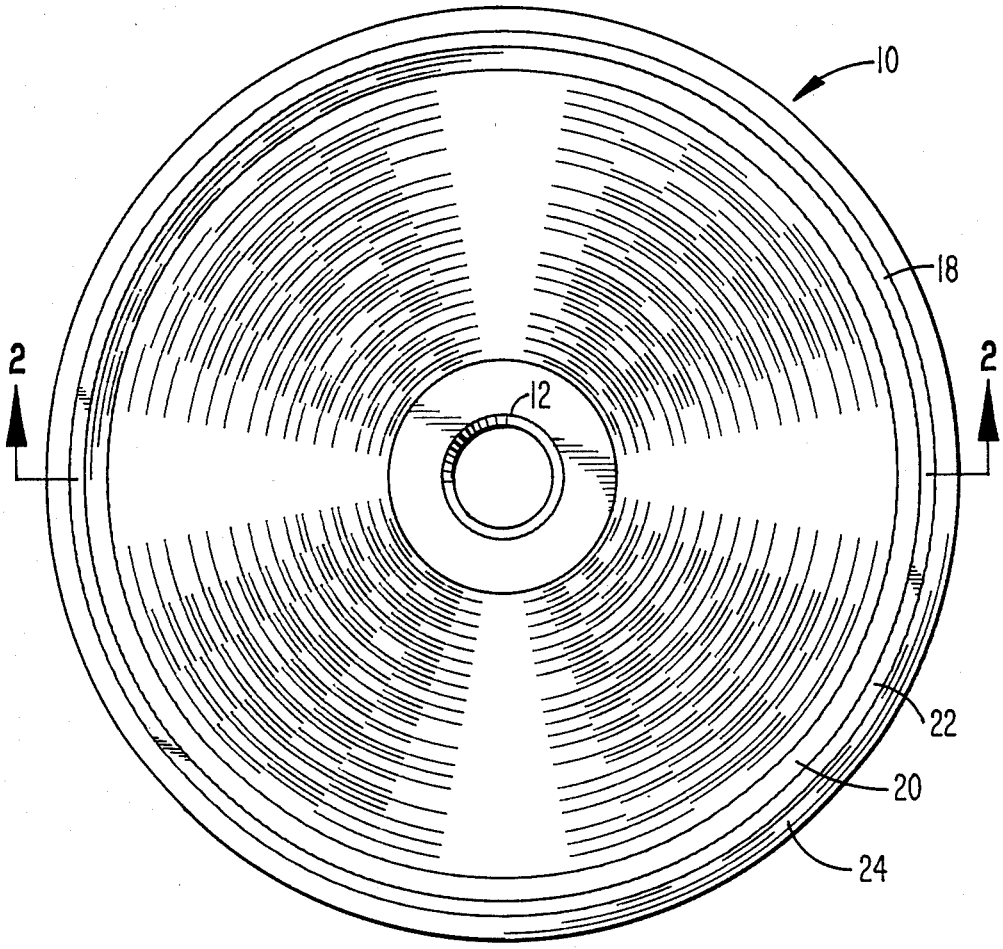
FIG. 1 is a top plan view of a stamper having formed inner and outer edges.
Figure 2:
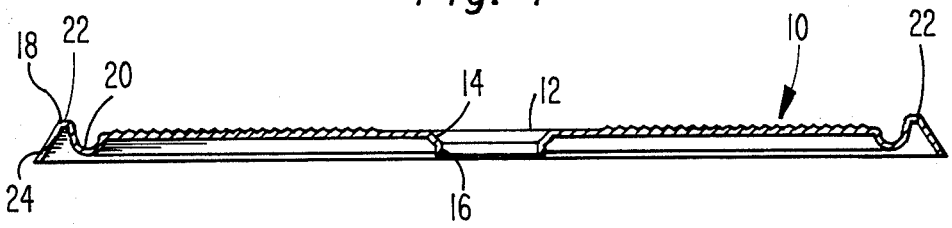
FIG. 2 is a cross-sectional view of the stamper of FIG. 1 taken as indicated by the lines and arrows 2 on FIG. 1.
Figure 3:
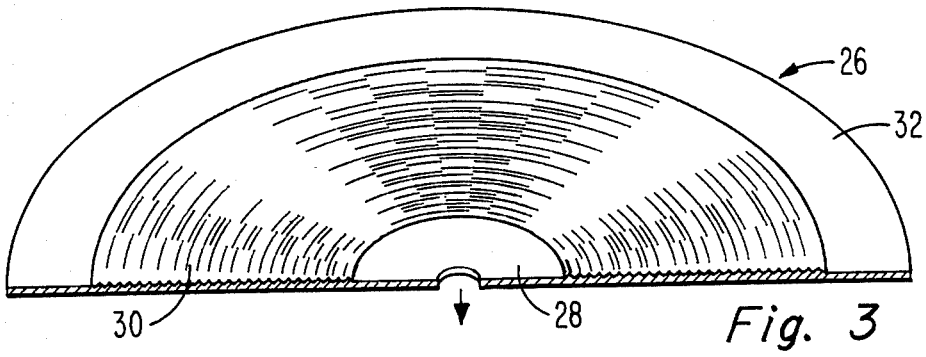
FIG. 3 is a perspective illustration in partial cross section of a half of a matrix as obtained from the matrixing process.
Figure 4:
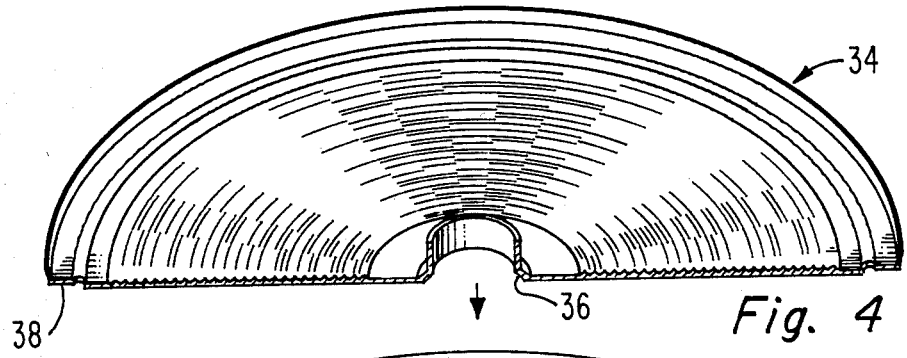
FIG. 4 is a perspective illustration in partial cross section of the matrix illustrated in FIG. 3 after the inner and outer sections have been shaped.

The stamper 10 illustrated in FIGS. 1 and 2 has a formed inner edge 12 of a predetermined configuration selected to mate with the center hole in the molding platen (not shown) of the record press and the molding pin (not shown) used to secure the stamper 10 to the molding platen. The inner edge 12 has a beveled portion 14 and a straight portion 16.

The stamper 10 illustrated in FIGS. 1 and 2 also has a formed outer edge 18 of a predetermined configuration. The outer edge 18 has a curved portion 20 which is used to mold a protective bead on the molded record. The outer edge 18 also has a flat portion 22 which is used to form a thin section in the flash and also to act as a molding land. The outer edge 18 further has an outer portion 24 which is bent so as to be able to be engaged by the ring (not shown) used to secure the stamper 10 to the outer edge of the molding platen.

The configuration of the inner and outer edges 12, 18 is relatively complex and it is important that the inner and outer edges 12, 18 be formed to relatively exact dimensions in order to have a proper fit of the stamper 10 to the molding platen. It is also important that the inner and outer edges 12, 18 be relatively strong as most of the forces encountered in the molding cycle are concentrated at the inner and outer edges 12, 18. However, the prior art method of stamping caused the inner and outer edges to be inherently weak as a result of the metal at edges of the stamper being stretched and placed under stress.

In the method of the present invention, the entire stamper 10 including the inner edge 12 and the outer edge 18, is electroformed in the required configuration.

The progressive steps employed in the method of the present invention are illustrated sequentially in FIGS. 3 through 6. For purposes of facilitating the explanation of the present invention, the parts shown in FIGS. 3 through 6 are illustrated by showing the parts cut in half. In this manner, it is possible to better understand the changes which occur in the cross section of the parts involved as well as the relationship of each part to the other parts. In actual practice, however, entire disc-shaped parts are formed in accordance with this invention.

In the practice of this invention, the initial step is to obtain a starting matrix 26 of the type generally referred to as a mother. The starting matrix 26 can be prepared using conventional matrixing procedures, such as those described above. The starting matrix 26 is a flat disc-shaped part which has a flat inner edge portion 28; a recorded area 30, which has defined therein a positive copy of a spiral information groove; and a flat outer edge portion 32. The starting matrix 26 can be electroformed from various metals provided the metal is capable of being shaped in a stamping operation or other similar process. It has been found that it is preferable to use a relative soft, easily deformable, ductile metal, such as a soft nickel, copper or the like, to form the starting matrix 26.

The starting matrix 26 is then subjected to a series of shaping steps to provide a shaped matrix 34. The shaping of the starting matrix 26 is preferably conducted by stamping. The flat inner edge portion 28 of the starting matrix 26 is formed into a shaped inner matrix edge 36 which is the mirror image of the electroformed inner edge 12 desired to be formed as part of the stamper 10. The outer edge portion 32 of the starting matrix 26 is likewise formed into a shaped outer matrix edge 38 which is the mirror image of the electroformed outer edge 18 desired to be formed as part of the stamper 10. The shaped matrix 34 which is obtained will have a configuration which is the mirror image of the stamper 10. If required, the surface of the formed matrix 34 is passivated in the conventional, well-known manner to prevent adhesion of electrodeposited metal to the surface of the shaped matrix 34.

Figure 5:
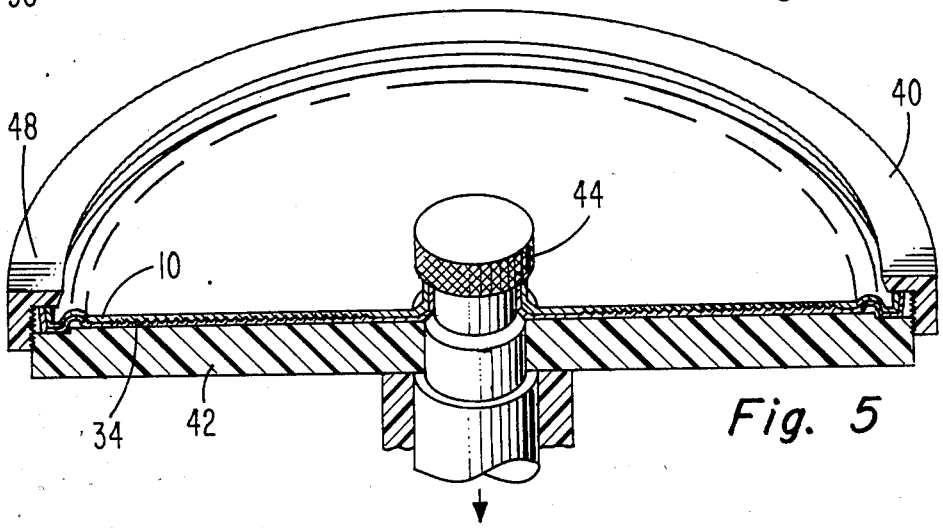
FIG. 5 is a perspective illustration in partial cross section of a half of a cathode head on which the matrix illustrated in FIG. 4 is mounted and on which a stamper is formed.
Figure 6:
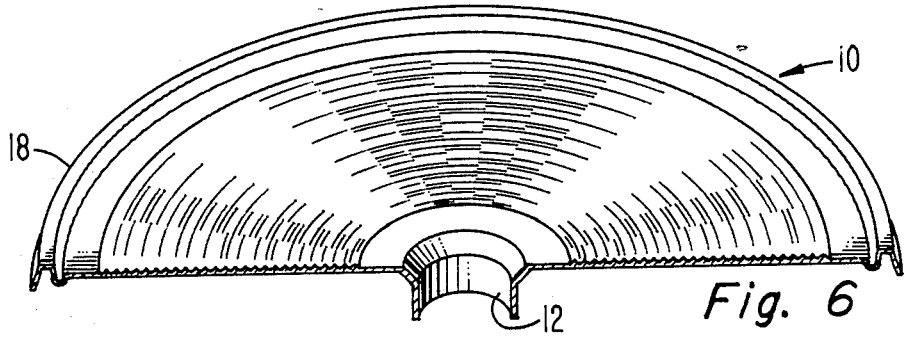
FIG. 6 is a perspective illustration in partial cross section of half of a stamper manufactured in accordance with this invention which has electroformed inner and outer edges.

As shown in FIG. 5, the shaped matrix 34 is mounted on a cathode head 40 of an electroforming apparatus (not shown). The cathode head 40 used in the method of this invention can be of a design similar to conventional cathode heads provided it is capable of holding a shaped matrix 34 for purposes of electroforming a stamper 10 thereon. For example, as shown in FIG. 5, the cathode head 40 has a disc-shaped support 42 on which the shaped matrix 34 is mounted; a cathode knob 44 for holding the center portion or shaped matrix 34 to the disc-shaped support 42 in contact with the cathode 40; and an outer lock ring 48 for securing the shaped outer matrix edge 38 to the cathode head 40.

The cathode head 40, with the shaped matrix 34, is positioned in an electroforming apparatus (not shown) and a stamper 10 is electroformed on the surface of the shaped matrix 34.

The stampers 10 can be electroformed from various metals, metal alloys and bimetallic combinations of metals. The most commonly used metal is nickel which is electrodeposited from a nickel sulfamate bath. It is also highly advantageous to electroform the stampers 10 from a relatively hard metal alloy, such as nickel-cobalt, in that hard stampers having electroformed edges can be obtained directly without requiring mechanical working of the inner and outer edges 12, 18. The present invention likewise has certain unique advantages when the stamper is made from bimetallic combinations such as when a hard metal, such as nickel or, more preferably, nickel-cobalt, is initially electroformed to form a hard surface layer for the stamper 10 and then the hard layer is backed up with a second metal, such as copper.

After an amount of metal, metal alloy or combination of metals, has been deposited to form the specified thickness for the stamper 10, the electrodeposition is stopped. The outer lock ring 48 of the cathode head 40 and the cathode knob 44 are removed. The stamper 10 is then stripped from the surfaces of the formed matrix 34. The electroforming of stampers 10 can be repeated by reapplying the lock ring 48 and the cathode knob 44 and electrodepositing sufficient metal to form an additional stamper 10, as noted above.

Using the method of this invention, the stampers 10 are manufactured with the electroformed inner and outer edges 12, 18. The electroformed stamper edges 12, 18 are more precise in dimensions than that of stampers having stamped edges. In addition, the problems of edge cracking commonly encountered with stampers having stamped inner and outer edges are virtually eliminated with the method of this invention. Since the stamper's 10 inner and outer edges 12, 18 do not have to be subjected to deformation by stamping, the stamper 10 can be electroformed from relatively hard metals which would normally crack during stamping, such as nickel-cobalt, as noted above. There are also cost advantages in that trimming steps and inner and outer edge stamping steps are eliminated. The direct electroforming of the inner and outer edges 12, 18 also reduces the time required for manufacture of completed stampers.

The stamper 10 produced in accordance with this invention, particularly those electroformed from relatively hard deposits of metal, have been found to produce high quality records and to have a long press life.

In describing the present invention, specific reference was made to the structural features of the stamper 10 illustrated in FIG. 1. It should be appreciated, however, that the disclosed invention is not limited to the specific stamper configuration illustrated in FIG. 1, but can be used to form various types of stampers having formed inner and outer edges without departing from the scope of the present invention.

I claim:

1. The method for the manufacture of a record stamper having a formed inner edge of a first predetermined configuration, a recorded section having a negative copy on an information track defined therein, and a formed outer edge of a second predetermined configuration; said method comprising the sequential the steps of: forming a matrix having a flat inner section, a recorded portion having positive copy of the information track defined therein, and a flat outer section; shaping the flat inner section into a form which is a mirror image of the first predetermined configuration; shaping the flat outer section into a form which is the mirror image of the second predetermined configuration; after the inner and outer sections of the matrix are shaped, electroforming a metal on the matrix in a preselected thickness required for the stamper; and separating the resulting stamper from the matrix, whereby a stamper is obtained having electroformed inner and outer edges of the predetermined configurations.

2. The method according to claim 1 where the matrix is electroformed from a relatively soft, easily deformable metal.

3. The method according to claim 1 where the flat inner section and the flat outer section are shaped by being stamped.

4. The method according to claim 1 wherein a relatively hard metal is electroformed on the matrix to form the stamper.

5. The method according to claim 1 wherein a nickel-cobalt alloy is electroformed on the matrix to form the stamper.

6. The method according to claim 1 where a relatively hard metal is initially electroformed on the matrix to form a face layer and thereafter, a second metal is electroformed on the back of the face layer.

* * * * *